US008167193B2

(12) United States Patent
Arai

(10) Patent No.: US 8,167,193 B2
(45) Date of Patent: May 1, 2012

(54) PACKAGING CONTAINER

(75) Inventor: Tomoaki Arai, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 1081 days.

(21) Appl. No.: 11/905,799

(22) Filed: Oct. 4, 2007

(65) Prior Publication Data

US 2008/0110965 A1 May 15, 2008

(30) Foreign Application Priority Data

Nov. 10, 2006 (JP) ..... 2006-277298

(51) Int. Cl.
*B65D 27/22* (2006.01)
*B65D 5/10* (2006.01)

(52) U.S. Cl. ..... 229/127; 229/67.4; 229/84; 229/108; 229/142; 229/153; 229/154; 229/928

(58) Field of Classification Search ..... 229/67.4, 229/76, 84, 108, 126, 127, 128, 142, 152, 229/153, 154, 928, 117.01, 117.02, 141, 229/143, 931
See application file for complete search history.

(56) References Cited

U.S. PATENT DOCUMENTS

| | | | | | |
|---|---|---|---|---|---|
| 899,654 | A | * | 9/1908 | Bloomer | 229/152 |
| 1,572,296 | A | * | 2/1926 | Kramer et al. | 229/117.01 |
| 1,795,293 | A | * | 3/1931 | Boeye | 229/120.04 |
| 2,468,123 | A | * | 4/1949 | Shina | 229/127 |
| 2,565,188 | A | * | 8/1951 | Welshenbach | 229/109 |
| 2,865,554 | A | * | 12/1958 | Repking et al. | 229/143 |
| 3,069,065 | A | * | 12/1962 | Bebout et al. | 229/920 |
| 3,226,007 | A | * | 12/1965 | Thies et al. | 229/127 |
| 3,371,845 | A | * | 3/1968 | Freiman | 229/247 |
| 3,446,414 | A | * | 5/1969 | Omori | 229/120.15 |
| 3,522,904 | A | * | 8/1970 | Locke et al. | 229/120.1 |
| 4,022,372 | A | * | 5/1977 | Graser | 229/931 |
| 4,062,487 | A | | 12/1977 | Bliss | |
| 4,126,266 | A | | 11/1978 | Roccaforte | |
| 5,048,749 | A | * | 9/1991 | Wischusen, III | 229/128 |

(Continued)

FOREIGN PATENT DOCUMENTS

JP 32-1484 3/1958

(Continued)

OTHER PUBLICATIONS

Japanese Office Action, (Nov. 2006).

*Primary Examiner* — Gary Elkins
(74) *Attorney, Agent, or Firm* — Harness, Dickey & Pierce, P.L.C.

(57) ABSTRACT

A packaging container for containing an object includes a substantially square-shaped first sheet member and a substantially square-shaped second sheet member overlaid on one another and forming four sides. At least one of the four sides forms an opening from which the object can be inserted. The packaging container also includes a first flap adjacent to the first sheet member through a first fold line at the opening, including a first cover piece to cover one half of the opening when folded, and a second flap adjacent to the second sheet member through a second fold line at the opening, including a second cover piece to cover another half of the opening when folded. The first flap and the second flap are provided at the opening so as not to overlap each other, and the first cover piece and the second cover piece cover substantially all the opening when folded.

19 Claims, 11 Drawing Sheets

U.S. PATENT DOCUMENTS 5,934,549 A * 8/1999 Baumgartner et al. .... 229/103.2

FOREIGN PATENT DOCUMENTS

| | | |
|---|---|---|
| JP | 58-161832 | 10/1983 |
| JP | 60-23143 | 2/1985 |
| JP | 62-95515 | 6/1987 |
| JP | 64-4664 | 2/1989 |
| JP | 1-82146 | 6/1989 |
| JP | 3-48027 | 10/1991 |
| JP | 11-292057 | 10/1999 |
| JP | 2002-053122 | 2/2002 |
| JP | 3094232 | 3/2003 |
| JP | 3110361 | 5/2005 |
| JP | 2005-178819 | 7/2005 |
| JP | 2006-051968 | 2/2006 |

* cited by examiner

PACKAGING CONTAINER

CROSS-REFERENCE TO RELATED APPLICATION

This patent application is based on and claims priority under 35 U.S.C. §119 from Japanese Patent Application No. 2006-277298 filed on Oct. 11, 2006 in the Japan Patent Office, the entire contents of which are incorporated herein by reference.

BACKGROUND OF THE INVENTION

1. Field of the Invention

Exemplary aspects of the present invention generally relate to a packaging container, and more particularly, to a packaging container having at least one opening from which an object can be inserted.

2. Discussion of the Background

Conventionally, when transporting an object, for example office automation (OA) equipment, various kinds of objects are packaged together with the OA equipment. Such, accompanying objects include, for example, an operating manual, a CD for installation of a program, a memory card, optional parts, and so forth.

Such objects are stored in a packaging container made of paper and are enclosed in a packaging container for storing the OA equipment main body.

The packaging container may be made as a single piece by cutting out a flat blank of coated board or cardboard, and the cutout is folded. The following packaging containers of this type have been proposed.

In Registration of Utility Model No. 3094232, fold lines are formed at both sides of an envelope in a vertical direction. The both sides are folded in accordance with the height of an object to be stored, and are adhered so that the strength is enhanced.

The cardboard envelope is formed such that a cardboard sheet with sealing flaps and adhesive flaps is folded while the adhesive flaps are adhered. On the bottom of the envelope, the fold lines are formed along the width direction. At both ends, the fold lines are vertically formed. A plurality of the vertical fold lines is provided at both sides.

In Registration of Utility Model No. 3110361, an envelope provided with a shock absorbing material is proposed. In other words, inside the envelope made of paper with a flap, there are ruled straight lines equally spaced between protruding portions, thereby forming a wave-like shape.

The shock absorbing sheet made of paper having the wave-like shape is folded in half along a designated ruled line for folding in half, such that the protruding portions face inside. The protruding portions at both ends of the shock absorbing sheet are crushed so as to attach to an opening rim of the envelope.

In Japanese Published Unexamined Application H11-292057, a sheet of cardboard folded to form a box-like packaging container is proposed.

According to the related art, a cut is provided in a folded flap at the end portion of an open side of a cover. A lock flap is inserted into the cut in the folded flap of the cover from the box main body so as to lock the cover.

In such a cardboard packaging container, a cut piece is formed on the lock flap at a position where a finger is placed.

In Japanese Published Unexamined Application S60-23143, a reinforcing structure for a packaging box is proposed. Reinforcing frames are provided in the packaging box so that even if a plurality of packaging boxes is stacked on one another, the packaging boxes are not damaged.

A plurality of holes is provided on the bottom of the packaging box. The packaging box is placed on a base made of copper, and the reinforcing frames disposed inside the packaging box are inserted in the holes of the base, thereby supporting the packaging box on the base.

In Japanese Published Unexamined Application 2005-178819, a container filled with objects stored therein is shrinkable and packaged by a box-shape or triangular packaging box is proposed.

After the stored objects are removed, the packaging box is depressed so that the packaging box is flattened for easier collection.

A first wall and a second wall opposite the first wall press the outer surface of the shrinkable container holding the object while the container is fixed to the packaging box by a frictional force.

Objects to be stored in the packaging container come in various thicknesses, sizes, and shapes, etc. That is, some objects are relatively thin, such as an instruction manual and a CD, while other objects are relatively thick, such as a memory card and optional parts.

However, the related art packaging containers described above may accommodate only a single form of object. Consequently, different packaging boxes which may accommodate various thicknesses are needed.

Therefore, in reality, when storing an object that is relatively thin, an envelope is used, and when storing an object that is relatively thick, a box-type packaging container is needed.

Envelopes are normally thin, and thus load efficiency is enhanced. On the other hand, stiffness is most likely low. Consequently, the envelopes are not suitable for packaging fragile objects.

At the same time, when using a box-type packaging container, a packaged object may not be damaged, because the six sides of the box-type packaging container are closed so that stiffness can be secured.

However, as described above, the thickness, volume, stiffness, and shapes of objects may vary. As a result, the cost for manufacturing the designated packaging containers becomes expensive.

In order to accommodate an object having a flexible shape, the above-described related art packaging container having a shrinkable shape has been proposed (Japanese Published Unexamined Application 2005-178819).

However, according to the related art, the object to be stored is the same, with the packaging container accommodating particular changes in the shape of the same object.

Furthermore, such packaging container does not have a structure that secures the stiffness of the container itself. Thus, it is not suitable for transportation of an object while maintaining the shape of the packaging container.

SUMMARY

In view of the foregoing, at least one example embodiment of the present invention provides a packaging container for containing an object.

An example embodiment according to the present invention provides a packaging container including a substantially square-shaped first sheet member and a substantially square-shaped second sheet member overlaid on one another and forming four sides. At least one of the four sides forms an opening from which the object can be inserted into the packaging container.

In example embodiments, the packaging container includes a first flap adjacent to the first sheet member through a first fold line at the opening, including a first cover piece to cover one half of the opening when folded, and a second flap adjacent to the second sheet member through a second fold line at the opening, including a second cover piece to cover another half of the opening when folded.

The first flap and the second flap are provided at the opening so as not to overlap each other, and the first cover piece and the second cover piece cover substantially all the opening when folded.

In example embodiments, the first flap and the second flap include a first spacer and a second spacer, respectively. The first spacer and the second spacer are each formed adjacent to the first cover piece and the second cover piece, respectively.

The first spacer and the second spacer maintain a space between the first sheet member and the second sheet member when inserted into the packaging container from the opening between the first sheet member and the second sheet member.

In example embodiments, the first spacer and the second spacer are paired with and overlap each other inside the packaging container when inserted into the packaging container from the opening between the first sheet member and the second sheet member.

In example embodiments, the first spacer and the second spacer are notched with a cut. The first spacer and the second spacer engage each other at the cut inside the packaging container when inserted into the packaging container from the opening between the first sheet member and the second sheet member.

In example embodiments, the first flap and the second flap further include a third flap and a fourth flap provided adjacent to the first cover piece and the second cover piece, respectively.

The third flap is configured to extend along a rear surface of the second sheet member and contact the second sheet member when folded, and the fourth flap is configured to extend along a rear surface of the first sheet member and contact the first sheet member when folded.

In example embodiments, the packaging container includes a fold line between the first spacer and the first cover piece, and a fold line between the second spacer and the second cover piece.

The first spacer and the second spacer are configured to be foldable along the fold line so as to overlay the first cover piece and the second cover piece, respectively.

The first spacer and the second spacer have a shape allowing the first spacer and the second spacer to be provided within a contour of the first cover piece and the second cover piece when the first spacer and the second spacer are overlaid on the first cover piece and the second cover piece, respectively.

In example embodiments, the packaging container includes a removal assisting mechanism including perforation between the first spacer and the first cover piece, and between the second spacer and the second cover piece.

In example embodiments, an end of the cut forms a tear prevention mechanism.

In example embodiments, contours of the first spacer and the second spacer are configured to be smaller than the first cover piece and the second cover piece when the first spacer and the second spacer are overlaid on the first cover piece and the second cover piece, respectively, and provide a space between the first sheet member and the second sheet member.

An example embodiment according to the present invention provides a packaging container for containing an object, including a substantially square-shaped first sheet member and a substantially square-shaped second sheet member overlaid on one another and forming four sides. At least one of the sides forms an opening from which the object can be inserted into the packaging container.

The packaging container includes a flap to close the opening. The flap includes a cover piece and a spacer. The cover piece is configured to cover the opening when folded. The spacer is configured to maintain a height of the opening.

An example embodiment according to the present invention provides a packaging container for containing an object, including a substantially square-shaped first sheet member and a substantially square-shaped second sheet member overlaid on one another and forming four sides. At least one of the sides forms an opening from which the object can be inserted into the packaging container.

The packaging container includes a flap to close the opening. The flap includes a cover piece and a deformation mechanism. The cover piece is configured to cover the opening when folded. The deformation prevention mechanism is configured to prevent deformation of the packaging container.

In example embodiments, the packaging container includes handling instructions for the packaging container provided on a surface thereof.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
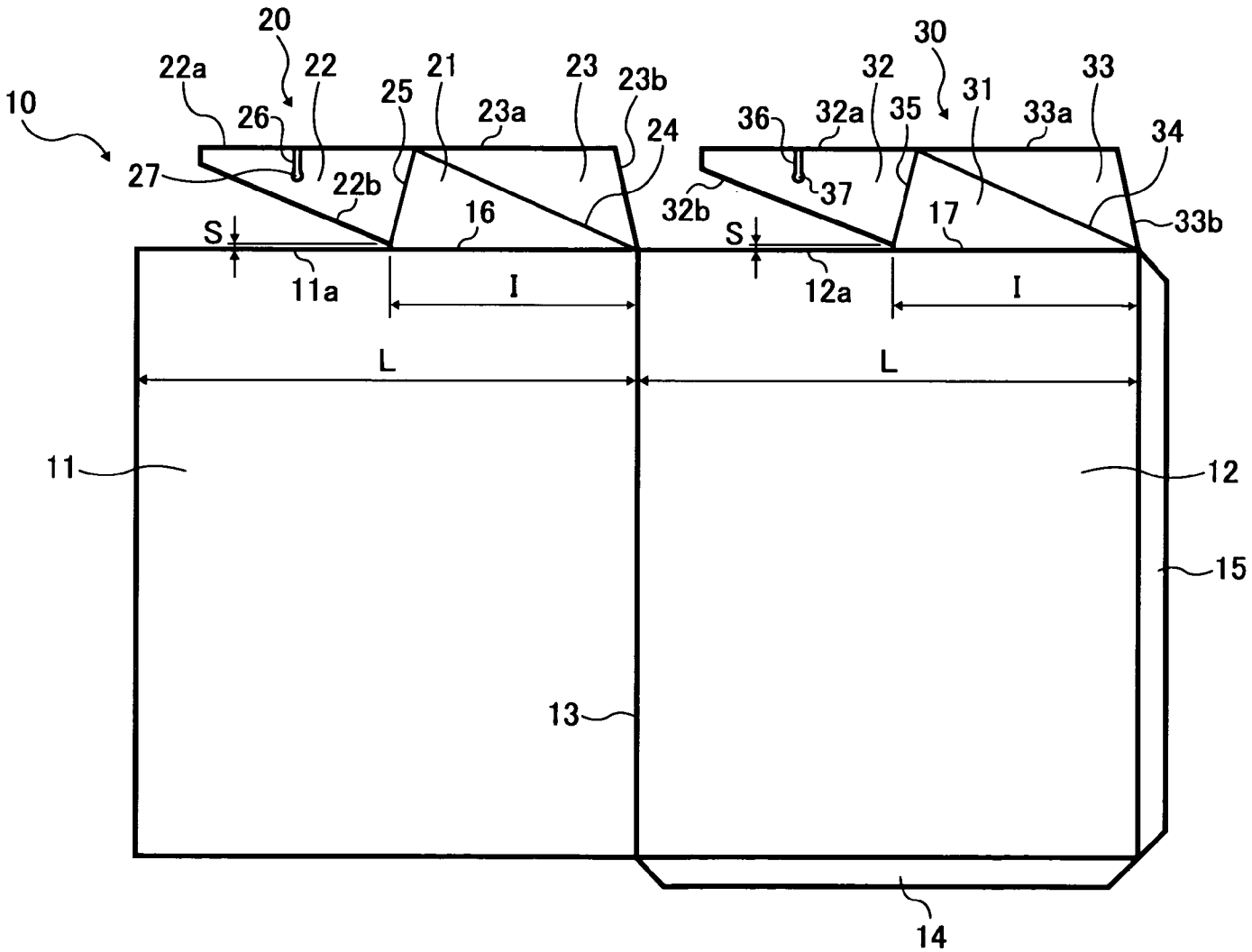
FIG. 1 is a developed view illustrating a flat blank, before folding, of a packaging container according to an example embodiment of the present invention.

Example embodiments of the present invention are described below with reference to the accompanying drawings.

It will be understood that if an element or layer is referred to as being "on," "against," "connected to" or "coupled to" another element or layer, then it can be directly on, against connected or coupled to the other element or layer, or intervening elements or layers may be present.

In contrast, if an element is referred to as being "directly on," "directly connected to" or "directly coupled to" another element or layer, then there are no intervening elements or layers present. Like numbers refer to like elements throughout figures. As used herein, the term "and/or" includes any and all combinations of one or more of the associated listed items.

Spatially relative terms, such as "beneath," "below," "lower," "above," "upper" and the like, may be used herein for ease of description to describe an element or an element's feature or relationship to another element(s) or feature(s) as illustrated in the figures.

It will be understood that the spatially relative terms are intended to encompass different orientations of the device in use or operation in addition to the orientation depicted in the figures.

For example, if the device in the figures is turned over, elements described as "below" or "beneath" other elements or features would then be oriented "above" the other elements or features. Thus, the term such as "below" can encompass both an orientation of above and below.

The device may be otherwise oriented at various angles (i.e. rotated 90 degrees or at other orientations), and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms.

These terms are used only to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a," "an" and "the" are intended to include the plural forms as well, unless the context clearly indicates otherwise.

It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

In the later described comparative example, example embodiment, and alternative example, for the sake of simplicity of drawings and descriptions, the same reference numerals will be given to constituent elements such as parts and materials having the same functions, and the descriptions thereof will be omitted unless otherwise stated.

With reference to FIGS. 1 through 14, a description will be now given of a packaging container according to example embodiments of the present invention.

FIG. 1 is a developed view illustrating the packaging container according to an example embodiment. A packaging container 10 is formed as a single piece by cutting out a flat blank of coated board or any other suitable material, and the cutout is assembled through folding and adhesion.

As shown in FIG. 1, the packaging container 10 includes at least two sheet members 11 and 12 connected at a connecting portion 13.

Upper ends 11*a* and 12*a* serve as open-end portions perpendicular to the connecting portion 13 of the sheet members 11 and 12. Flap portions 20 and 30 are provided to upper ends 11*a* and 12*a*, respectively. Fold lines 16 and 17 are provided between the upper ends 11*a* and 12*a*, and the flap portions 20 and 30, respectively.

The sheet member 11 and the flap portion 20 have a similar if not identical shape as the shape of the sheet member 12 and the flap 30, respectively. The sheet member 11 and the flap portion 20 are disposed such that the sheet member 11 and the flap portion 20 adjoin the sheet member 12 and the flap portion 30 through the connecting portion 13.

The sheet member 12 further includes gluing tabs 14 and 15 at two sides of the sheet member 12 for allowing the sheet member 12 to adhere.

The flap portion 20 includes: a cover piece 21 connected to the sheet member 11 through the fold line 16; a spacer 22 connected to the cover piece 21 through a fold line 25; and a flap 23 connected to the cover piece 21 through a fold line 24.

The flap portion 30 includes: a cover piece 31 connected to the sheet member 12 through the fold line 17; a spacer 32 connected to the cover piece 31 through a fold line 35; and a flap 33 connected to the cover piece 31 through a fold line 34.

The cover piece 21 of the flap portion 20 has a substantially isosceles triangular shape with two sides, that is, the fold line 16 extended from the upper end 11*a* and the fold line 24, having similar if not identical lengths, with the fold line 25 constituting the remaining side.

A length (l) of the fold line 16 is slightly shorter than half a width (W) of the sheet member 11. For example, the length of the fold line 16 is shorter than half the width (W) by an amount equal to a thickness of the coated board.

The cover piece 31 of the flap portion 30 has a substantially isosceles triangular shape, with two sides, that is, the fold line 17 and the fold line 34, both having similar if not identical lengths, and the fold line 35 constituting the remaining side.

Similarly, the length (l) of the fold line 17 is slightly shorter than half the width (W) of the sheet member 12.

Figure 3:
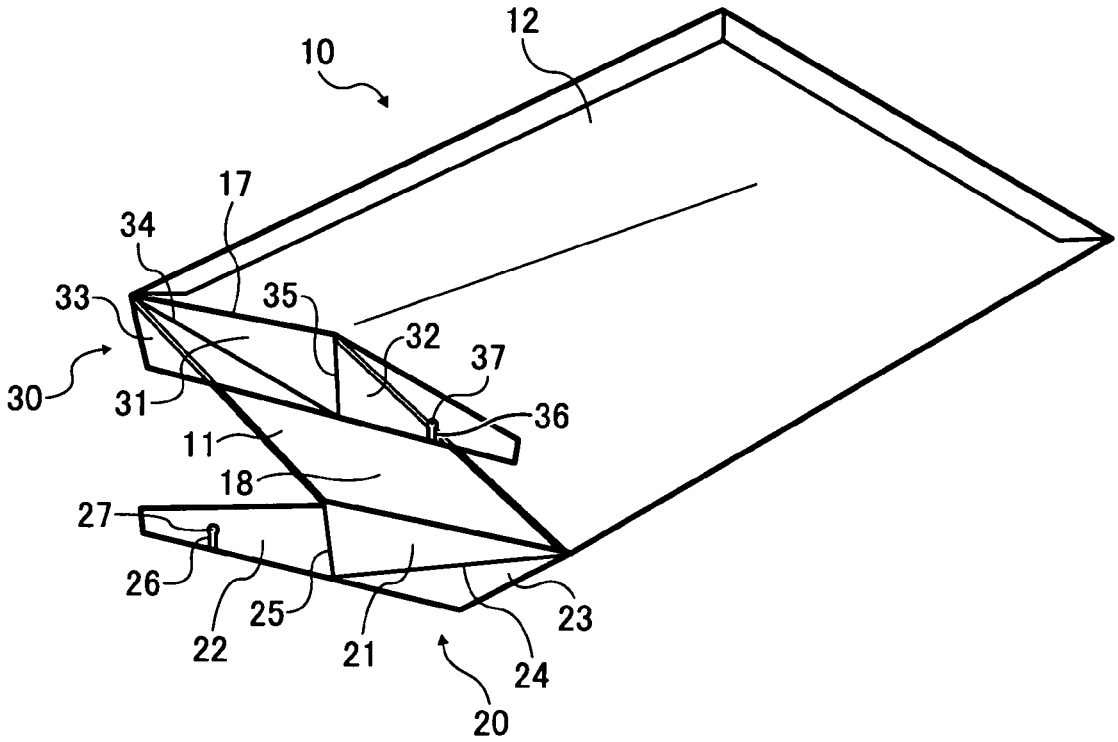
FIG. 3 is a perspective view illustrating the packaging container.

The cover pieces 21 and 31 each cover substantially half an area of an opening 18 of the packaging container 10 as shown in FIG. 3. Accordingly, an entire area of the opening 18 is substantially covered by the two cover pieces 21 and 31.

The spacer 22 of the flap portion 20 has a square shape having sides including the fold line 25, an upper end 22*a*, and a lower end 22*b*.

The upper end 22*a* is formed parallel to the upper end 11*a*.

The lower end 22*b* is formed such that it connects to the fold line 25 leaving a space (S) between the lower end 22*b* and the upper end 11*a* of the sheet member 11.

In other words, the spacer 22 is formed such that, when the spacer 22 is folded along the fold line 25 that connects the spacer 22 to the cover piece 21 to overlap the cover piece 21, the spacer 22 is provided within a contour of the cover piece 21.

Furthermore, when the spacer 22 is folded along the fold line 25, a space is formed between the lower end 22*b* of the spacer 22 and the fold line 16.

A cut portion 26 for allowing the spacer 22 to engage the spacer 32 is formed so as to extend from a substantially center position of the upper end 22*a* of the spacer 22 to approximately the middle of the width of the spacer 22.

The width of the cut portion 26 is determined taking into account of the thickness of the coated board that constitutes the packaging container 10.

At the tip of the cut portion 26 is provided a hole 27 serving as a tear prevention mechanism connected to the cut portion 26 in order to reduce the likelihood of, if not prevent entirely, a tear due to concentration of stress.

The spacer 32 of the flap portion 30 has a square shape having sides including the fold line 35, an upper end 32*a*, and a lower end 32*b*.

The upper end 32*a* is formed parallel to the upper end 12*a*.

The lower end 32*b* is formed such that it connects to the fold line 25 leaving a space (S) between the lower end 32*b* and the upper end 12*a* of the sheet member 12.

In other words, the spacer 32 is formed such that, when the spacer 32 is folded along the fold line 35 that connects the spacer 32 to the cover piece 31 so as to overlap the cover piece 31, the spacer 32 is provided within a contour of the cover piece 31.

Furthermore, when the spacer 32 is folded along the fold line 35, a space is formed between the lower end 32*b* of the spacer 32 and the fold line 17.

A cut portion 36 for allowing the spacer 32 to engage the spacer 22 is formed so as to extend from a substantially center position of the upper end 32*a* of the spacer 32 to approximately the middle of the width of the spacer 32.

The width of the cut portion 36 is determined taking into account of the thickness of the coated board that constitutes the packaging container 10.

At the tip of the cut portion 36 is provided a hole 37 connected to the cut portion 36 in order to reduce the likelihood of, if not prevent altogether, a tear due to concentration of stress.

When the spacers 22 and 32 are folded along the fold lines 25 and 35, respectively, the spacers 22 and 32 are inserted into the packaging container 10 from the opening and arranged between the sheet members 11 and 12.

The spacers 22 and 32 engage each other at the cut portions 26 and 36 while maintaining a given space between the sheet members 11 and 12.

The flap 23 of the flap portion 20 has a substantially triangular shape with sides including the fold line 24, an upper end 23*a*, and a side 23*b*.

The upper end 23*a* is in alignment with the upper end 22*a* of the spacer 22 and parallel to the upper end 11*a* of the sheet member 11 and the fold line 16.

The side 23*b* is formed such that it slants inward relative to the fold line 16.

Similarly, the flap 33 of the flap portion 30 has a substantially triangular shape with sides including the fold line 34, an upper end 33*a*, and a side 33*b*.

The upper end 33*a* is in alignment with the upper end 32*a* of the spacer 32 and parallel to the upper end 12*a* of the sheet member 12 and the fold line 17.

The side 33*b* is formed such that it slants inward relative to the fold line 17.

When assembling the flat blank, the flaps 23 and 33 come into contact with an opposing inner surface of the sheet members 11 and 12 so that the shape of the packaging container 10 is secured.

The flap portions 20 and 30 are formed without extending excessively from the proximity of the sheet members 11 and 12. Therefore, it is possible to enhance efficiency of cutting out from a flat blank.

A description will now be given of an assembly of the packaging container 10.

Figure 2:
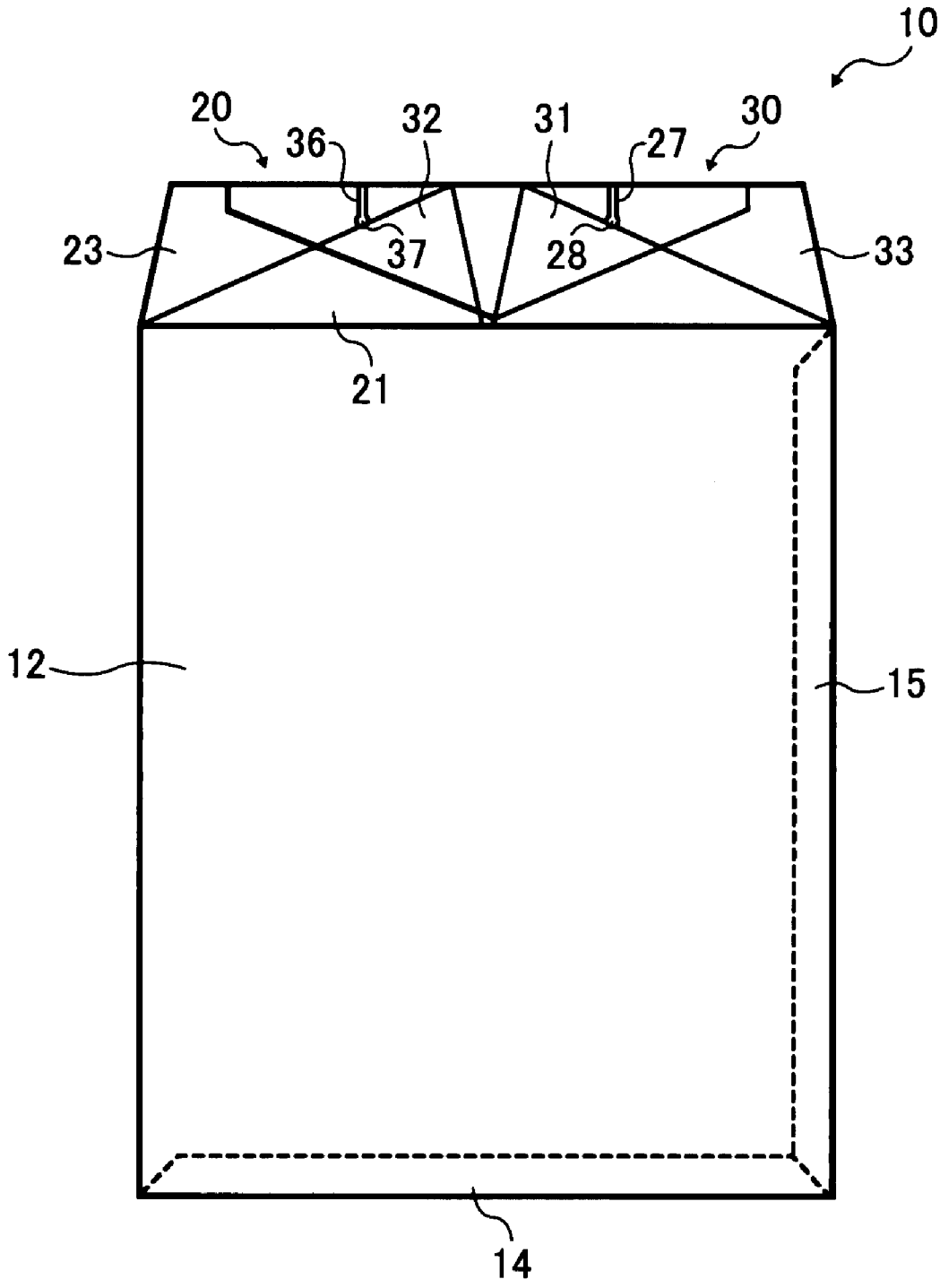
FIG. 2 is a plan view illustrating the packaging container of FIG. 1.

FIG. 2 shows a plan view of the packaging container 10 according to the example embodiment. FIG. 3 is a perspective view illustrating the packaging container 10 according to the example embodiment.

When assembling the flat blank, the packaging container 10 is formed in a manner as shown in FIGS. 2 and 3. In this state as shown in FIGS. 2 and 3, three ends of the sheet members 11 and 12, that is, the left and the right sides and the bottom in FIG. 2 are sealed. The other end, that is, an end corresponding to an upper end in FIGS. 2 and 3, is formed as an opening.

When the sheet members 11 and 12 are bent, the opening 18 for taking an object in and out is open. It is possible to close the opening 18 with the cover pieces 21 and 31.

As shown in FIG. 2, when the packaging container is assembled and is in a state in which no object is stored inside thereof, the flap portions 20 and 30 provided to the sheet members 11 and 12, respectively, are at a protruding position.

FIG. 3 illustrates the packaging container 10 in a state in which the flap portion 30 provided to the sheet member 12 is folded by a small amount along the fold line 17.

Next, a description is given of the packaging container 10 when storing an object. First, a description is given of a case in which an object with some thickness is stored.

Figure 4A:
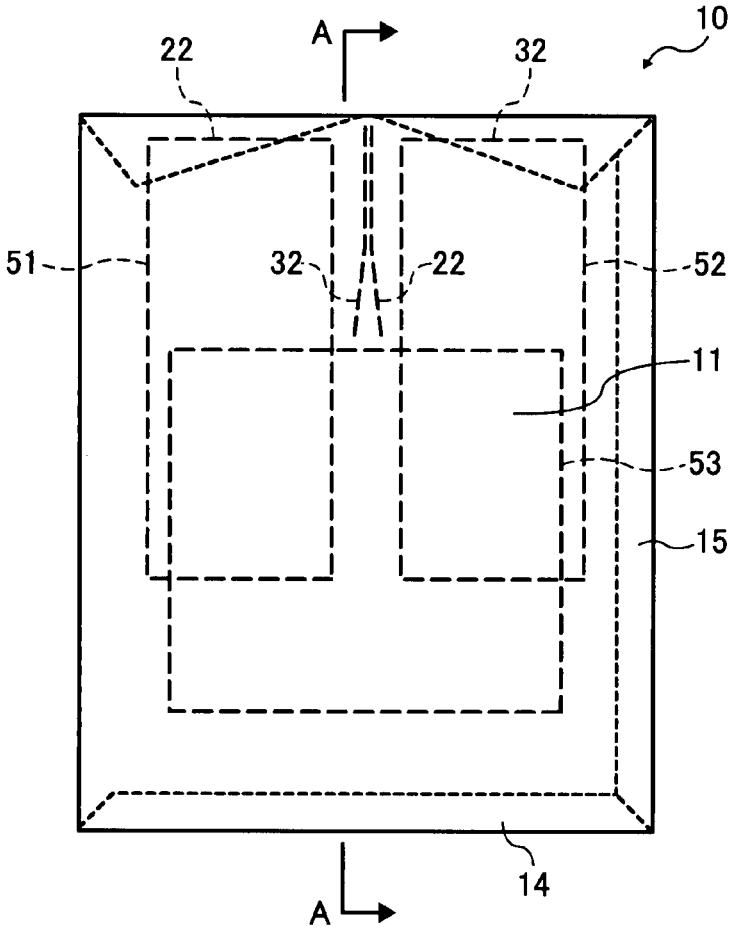
FIGS. 4A, 4B and 4C show plan, side and front views, respectively, of the packaging container in a state in which an object with some thickness is stored therein according to an example embodiment.
Figure 4B:
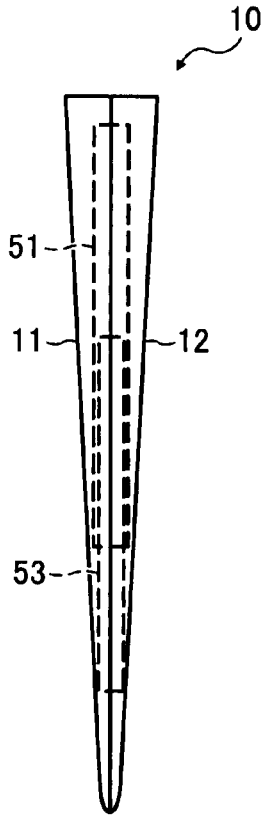
Figure 4C:
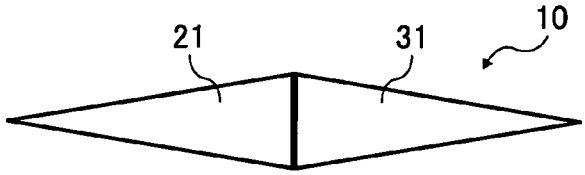

FIGS. 4A, 4B and 4C show a state in which an object is stored in the packaging container 10.

FIG. 4A is a plan view illustrating the packaging container 10 storing an object with some thickness according to the example embodiment. FIG. 4B is a side view illustrating the packaging container 10 according to the example embodiment. FIG. 4C is a front view illustrating the packaging container 10 according to the example embodiment.

Figure 5:
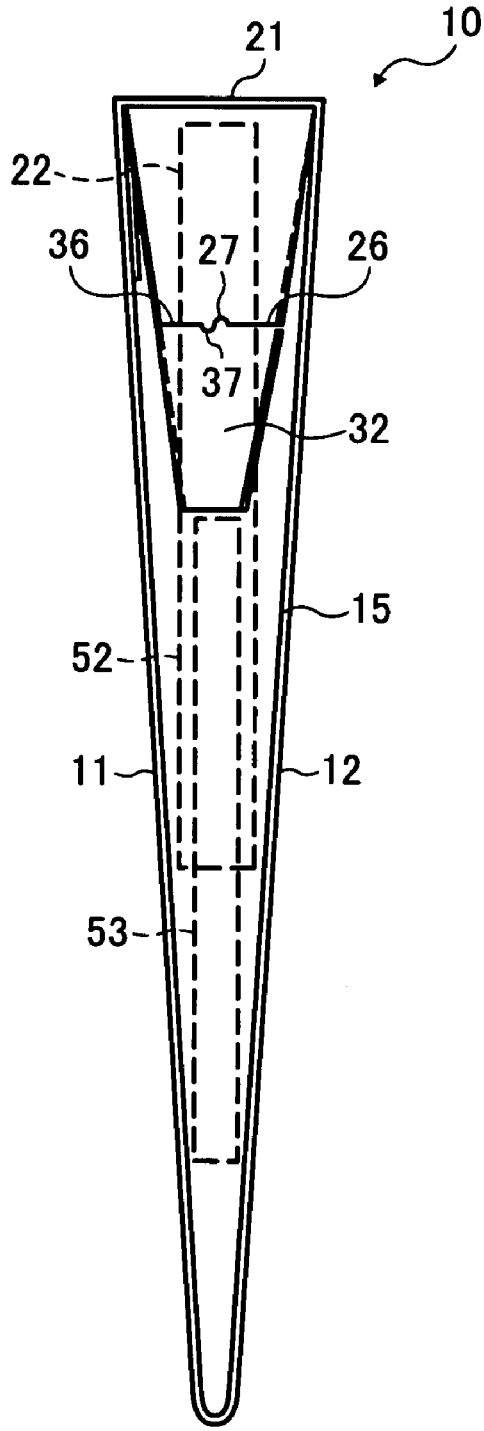
FIG. 5 is a cross-sectional view of the packaging container taken along A-A line of FIG. 4A when storing an object with some thickness.

FIG. 5 is a cross-sectional view illustrating the packaging container 10 according to the example embodiment, taken along A-A line of FIG. 4A when storing an object with some thickness.

Figure 6:
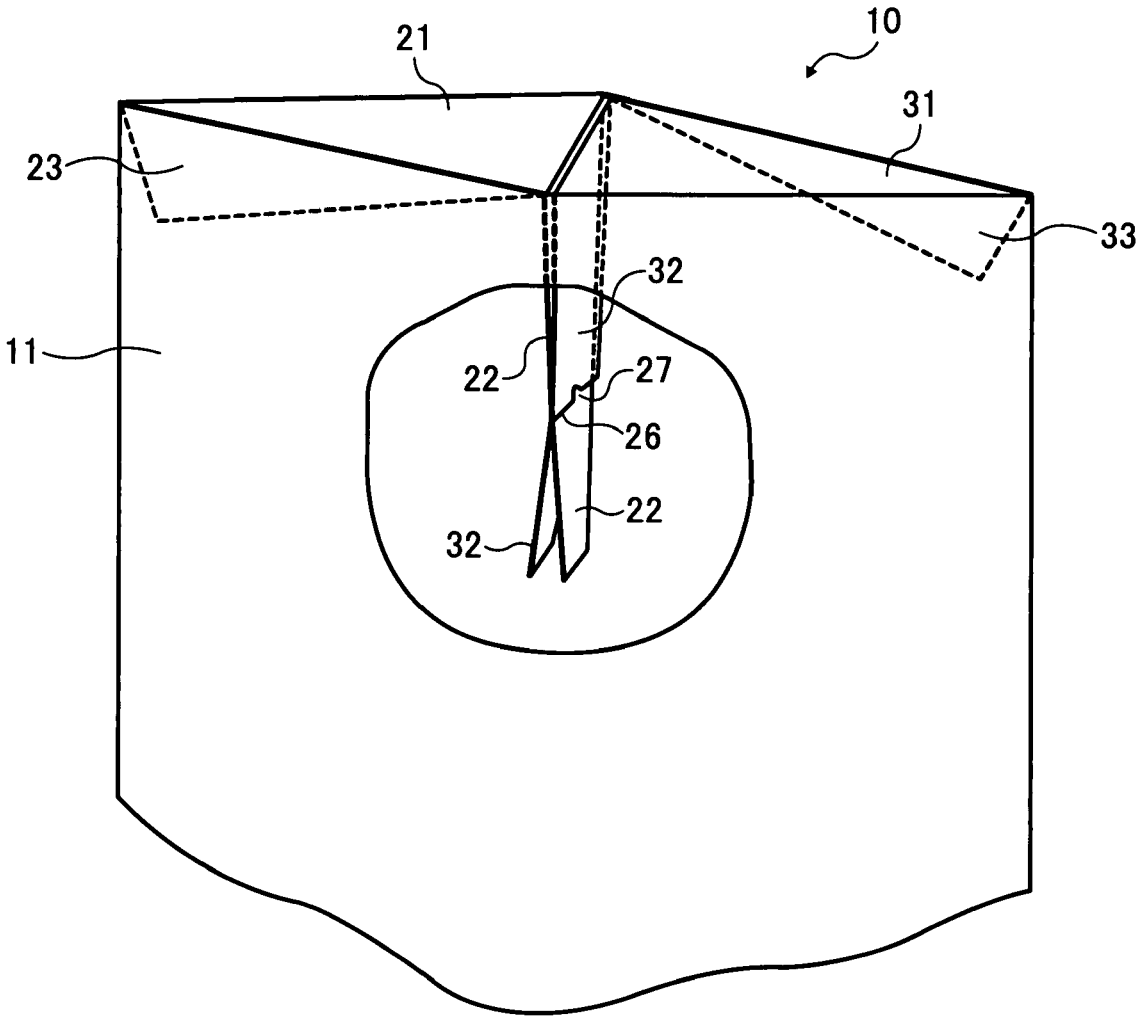
FIG. 6 is a broken perspective view illustrating a portion of the packaging container.

FIG. 6 is a broken perspective view illustrating a portion of the packaging container 10.

FIGS. 7 through 10 are perspective views illustrating a flap folding sequence when assembling the packaging container 10.

Figure 11:
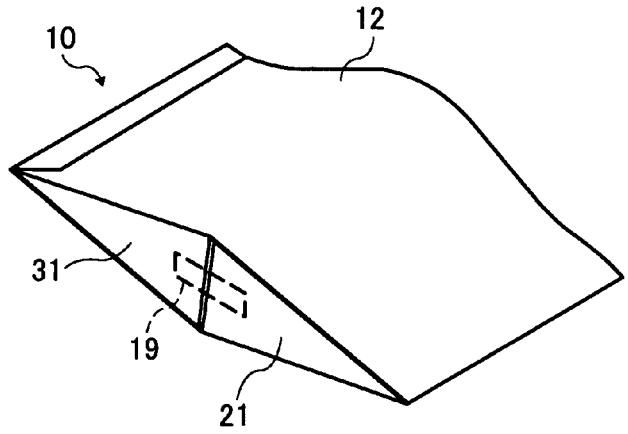
FIG. 11 is a perspective view illustrating the packaging container when assembly is completed.

FIG. 11 is a perspective view illustrating the packaging container 10 when assembly is completed.

The packaging container 10 may store two objects 51 and 52 with some thickness or at least one object 53. In FIGS. 4A-4C and FIG. 5, reference numerals 51 through 53 represent an object to be stored.

As shown in FIGS. 4A-4C and FIG. 5, two objects 51 and 52 may be stored sandwiching the cut portions 26 and 36.

The object 53 may be stored avoiding the cut portions 26 and 36.

Referring back to FIG. 3, the opening side of the sheet members 11 and 12 are opened so as to form the opening 18. In this state, the objects 51 thorough 53 wrapped by a shock absorbing material or without the shock absorbing material may be stored from the opening 18.

Figure 7:
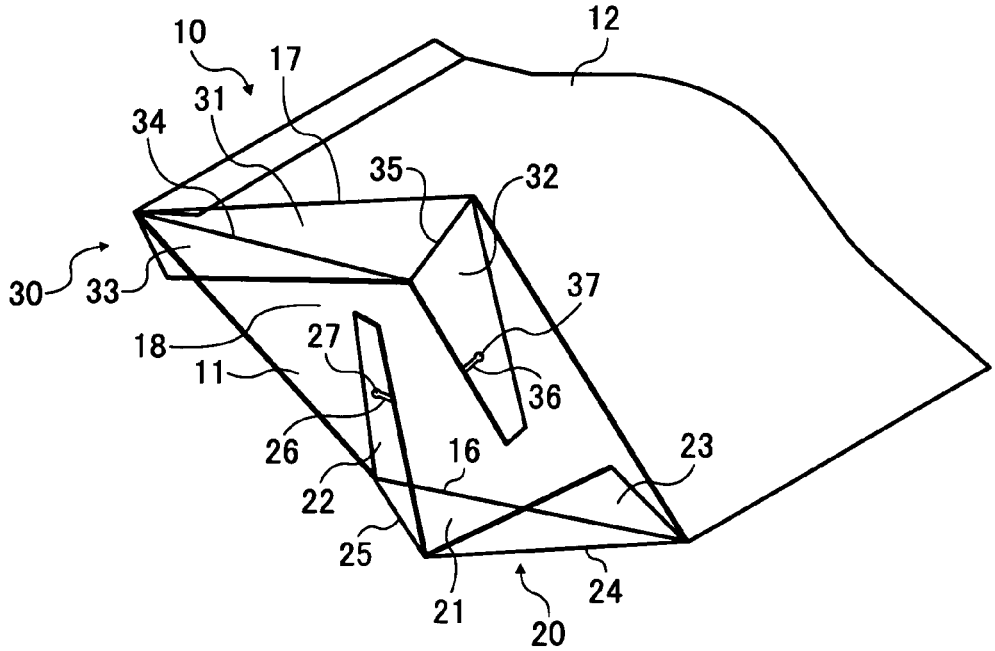
FIGS. 7 through 10 are perspective views illustrating an exemplary flap folding procedure executed when assembling the packaging container.

Subsequently, as shown in FIG. 7, the spacers 22 and 32 are folded toward the opening 18 along the fold lines 25 and 35, respectively.

Figure 8:
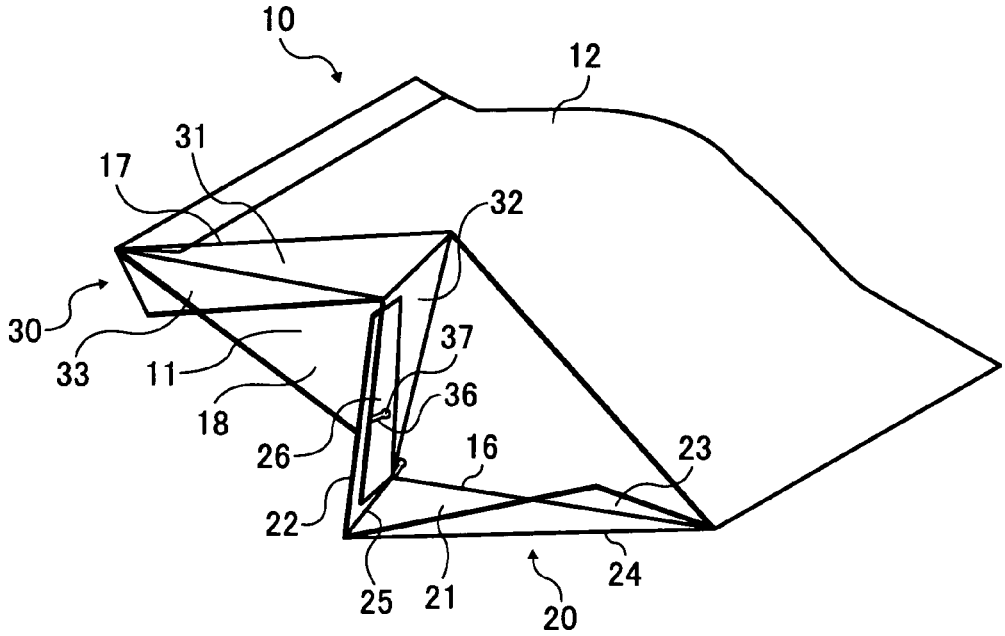

Next, as shown in FIG. 8, the spacers 22 and 32 are overlaid on one another.

Figure 9:
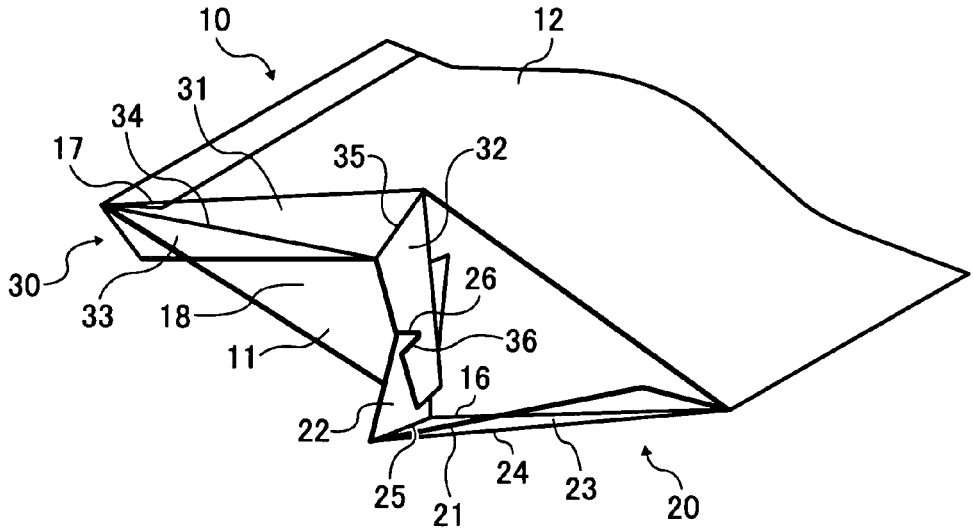

Next, as shown in FIG. 9, the cut portions 26 and 36 are locked with each other while the flaps 23 and 33 are folded inward along each of the respective fold lines 24 and 34.

Figure 10:
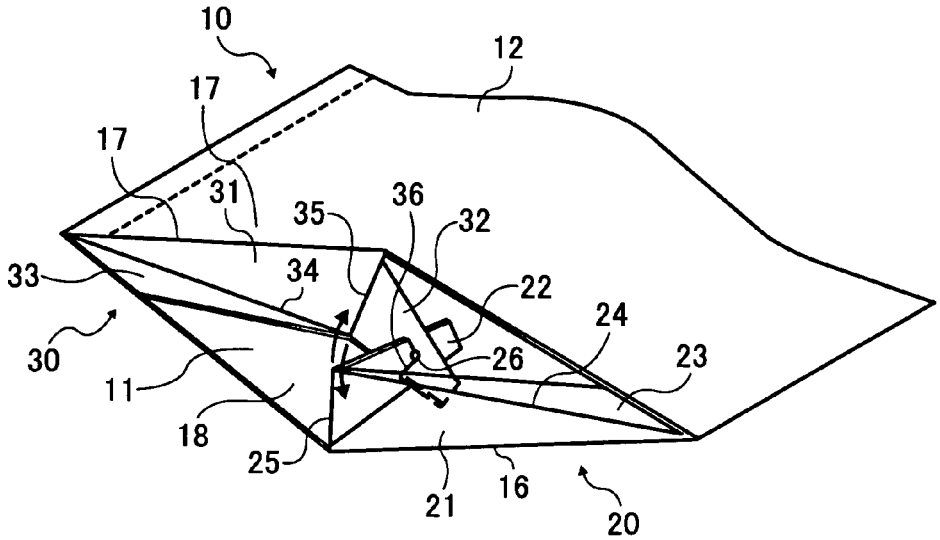

As shown in FIG. 10, the flaps 23 and 33 are folded inside of the sheet members 11 and 12, and the spacers 22 and 32 are twisted inward as shown by an arrow direction around the holes 27 and 37 formed at the tip of the cut portions 26 and 36 engaged with each other, allowing the spacers 22 and 32 to be positioned inside.

Accordingly, as shown in FIG. 11, the cover pieces 21 and 31 cover the opening 18. The packaging container 10 is in a state where the object is stored. An adhesive tape 19 or the like may be adhered across the cover pieces 21 and 31 as needed so that the cover pieces 21 and 31 are fixed.

In this state, as shown in FIG. 6, the spacers 22 and 32 are crossed and engaged with each other at the cut portions 26 and 36.

Furthermore, because the length (l) of the fold lines 16 and 17 of the cover pieces 21 and 31 are configured to be a little shorter than substantially half the width (W) of the sheet members 11 and 12, the fold lines 25 and 35 do not closely contact each other.

Therefore, when assembling, the spacers 22 and 32 are separated from each other by a small amount at the fold lines 25 and 35. The flaps 23 and 33 are crossed in an X-like shape and engaged with each other.

Accordingly, the spacers 22 and 32 so engaged are stabilized between the sheet members 11 and 12.

The upper ends 22*a* and 32*a* of the respective spacers 22 and 32, and the lower ends 22*b* and 32*b*, are disposed in the proximity of the inside of the sheet members 11 and 12. Therefore, the spacers 22 and 32 serve as a brace for the packaging container 10 to reduce the likelihood of, if not prevent, deformation of the packaging container.

When the packaging container is in an assembled state, the flaps 23 and 33 come into contact with the inner surface of the sheet members 11 and 12. Therefore, the flaps 23 and 33 may close a space around the peripheral area of the opening 18. Furthermore, a load on the sheet members 11 and 12 is supported by the cover pieces 21 and 31.

Accordingly, even if stress is applied from an upper surface of the sheet members 11 and 12, the shape of the packaging container 10 is maintained by the cover pieces 21 and 31, and the spacers 22 and 32.

Subsequently, an adhesive tape or the like may be adhered to the flap portion 20 as needed.

In this state, as shown in FIGS. 4A through 4C, the three surfaces including the sheet member 11, the sheet member 12, and the surface formed by the cover pieces 21 and 31, constitute the packaging container 10.

Furthermore, the packaging container 10 has a three dimensional structure having a deformation prevention mechanism constituted by the spacers 22 and 32 inside the packaging container 10.

This structure enhances stiffness relative to a compression, distortion and so forth, thereby protecting the objects 51, 52 and 53 stored inside.

The packaging container 10 according to the example embodiment includes the flap portions 20 and 30 integrally including the cover pieces 21 and 31, the spacers 22 and 32, and the flaps 23 and 33.

Accordingly, even if the structure is simple and compact, such a structure enhances the stiffness of the packaging container.

In addition, the packaging container 10 has a thin-walled structure from the opening 18 toward the direction of the connecting portion 13 facing one direction. Therefore, when stacking the packaging containers 10, the opening 18 and the connecting portion 13 may be overlaid on one another, enhancing storage efficiency.

Furthermore, the packaging container 10 provides multiple flat surfaces for adhering a label displaying a bar code, an identifier and so forth on the sheet members 11 and 12 and the cover pieces 21 and 31.

The label may be adhered to an area from the cover pieces 21 and 31 to the sheet member 12, to function as the above-described adhesive tape 19.

Next, a description is given of the packaging container 10 in a case of storing a thin object such as an instruction manual, a CD or the like, according to another example embodiment.

Figure 12:
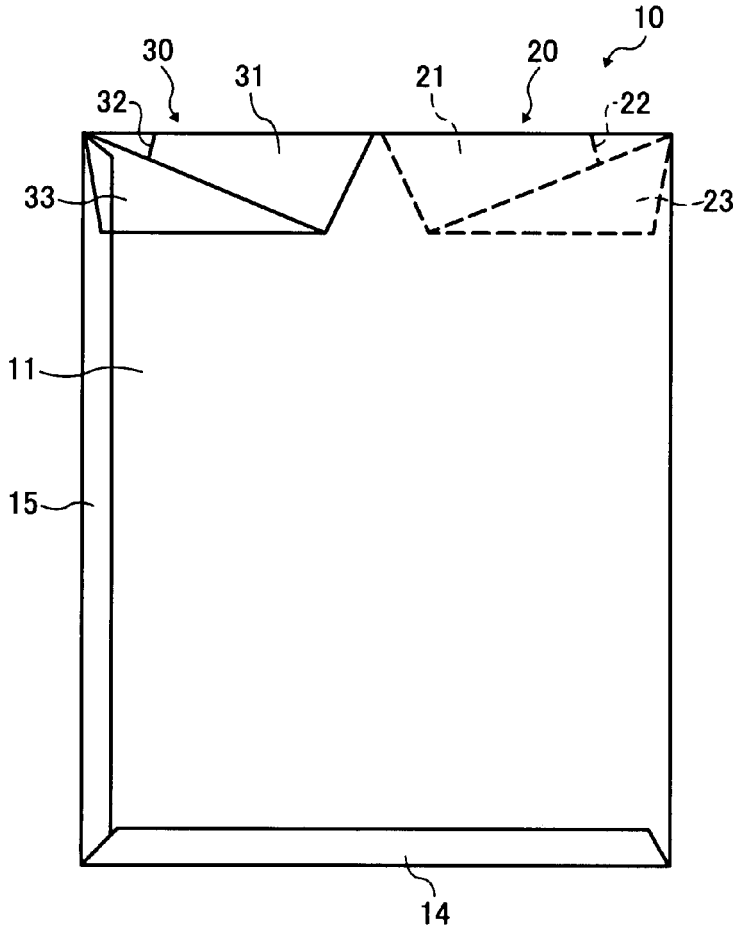
FIG. 12 is a plan view illustrating the packaging container in a case in which a thin object is stored therein.

FIG. 12 is a plan view illustrating the packaging container 10 when storing a thin object. When storing a thin object, the packaging container 10 may be used in a form of an envelope.

In this case, as shown in FIG. 12, the cover piece 21 and the flap 23 as one piece, and the cover piece 31 and the flap 33 as one piece, are folded in different directions, nipping the sheet members 11 and 12.

In other words, the cover piece 21 and the flap 23 as one piece are folded over the sheet member 12, while the cover piece 31 and the flap 33 as one piece are folded over the sheet member 11.

Accordingly, the opening 18 formed between the sheet members 11 and 12 is closed. At this time, the spacers 22 and 32 may be folded inside the cover pieces 21 and 31 so that it becomes possible to enclose the spacers 22 and 32 behind the cover pieces 21 and 31.

The flaps 23 and 33 have a shape which allows the flaps 23 and 33 to be disposed within the contours of the cover pieces 21 and 31. Therefore, the spacers 22 and 32 do not protrude out of the cover pieces 21 and 31.

Furthermore, it is possible to tear off the flaps 22 and 32 from the cover pieces 21 and 31, when a removal assisting processing, for example, perforation, is performed at the fold line 25 between the cover piece 21 and the spacer 22, and at the fold line 35 between the cover piece 31 and the spacing panel 32.

Therefore, it is possible to remove the spacers 22 and 32 from the cover pieces 21 and 31 easily, without using equipment such as scissors, a knife, or the like.

According to the example embodiment, the packaging container 10 may display instructions for the packaging container 10.

Figure 13:
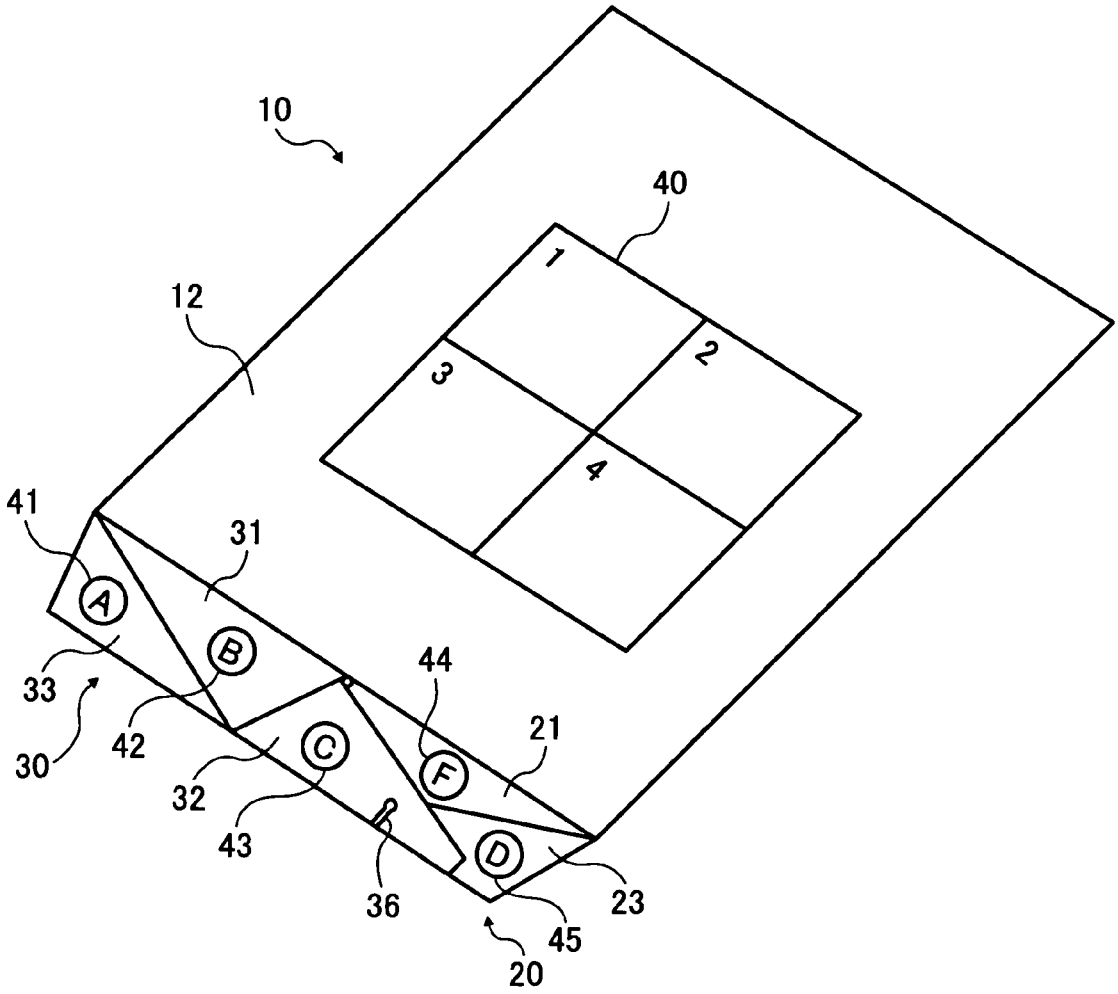
FIG. 13 is a perspective view illustrating a packaging container displaying instructions according to another example embodiment.
Figure 14:
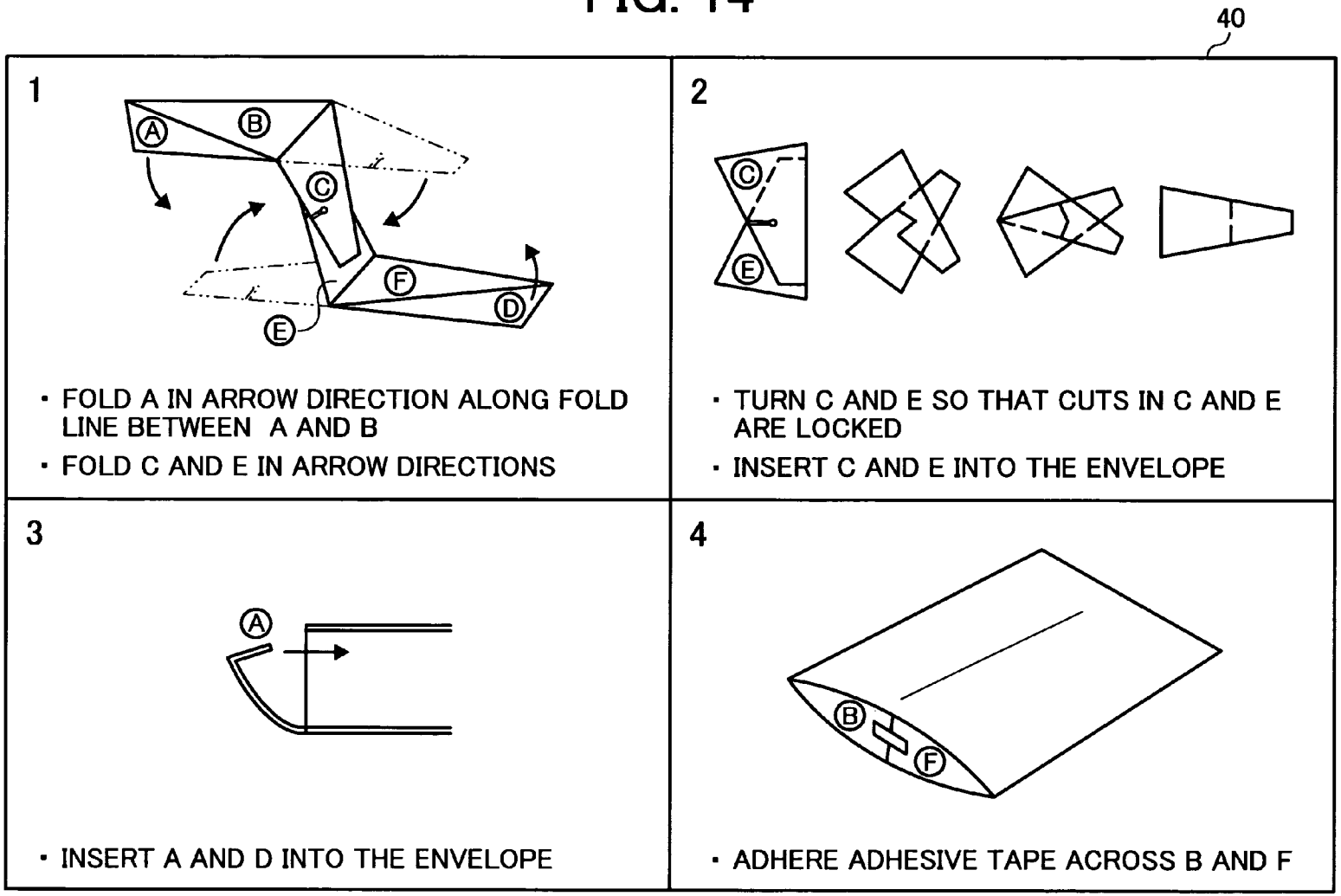
FIG. 14 is a diagram illustrating an example of the instructions to be displayed on the packaging container of FIG. 13.

FIG. 13 is a perspective view illustrating the packaging container 10 displaying instructions. FIG. 14 is a diagram illustrating an example of the instructions to be displayed on the packaging container 10.

In FIG. 13, an assembling procedure diagram 40 is provided on a surface of the sheet member 12 of the packaging container 10. Letter symbols (A) through (F) are provided for the cover pieces 21 and 31 of the flap portions 20 and 30, the spacers 22 and 32, and the flaps 23 and 33.

As shown in FIG. 14, the assembling procedure diagram 40 according to the example embodiment includes illustrations illustrating four steps 1 through 4 with reference to the letter symbols when the packaging container 10 stores an object having some thickness.

Accordingly, including the assembling procedure diagram 40 on the sheet member of the packaging container 10 enables a user to assemble the packaging container 10 with ease by referring to the assembling procedure diagram 40.

In the above-described example embodiments, the sheet member may be made of a paper coated board. Alternatively, however, the sheet member may be made of other materials such as paper cardboard, a resin sheet, plastic cardboard, or any other suitable material.

Accordingly, use of such other materials enhances the durability of the packaging container, allowing the packaging container to be reused repeatedly.

In the example embodiments, the connecting portion connecting the two sheet members is formed perpendicular to the upper end serving as the opening. Alternatively, the connecting portion connecting the two sheet members may be formed facing the opening.

Additionally, although in the example embodiments, the opening is formed at one side of the packaging container, and the flap portions are formed at the opening, alternatively, two openings may be formed at two opposing sides facing each other and the flap portions may be formed at the two openings, respectively.

Furthermore, elements and/or features of different example embodiments may be combined with each other and/or substituted for each other within the scope of this disclosure and appended claims.

The number of constituent elements, locations, shapes and so forth of the constituent elements are not limited to any of the structure for performing the methodology illustrated in the drawings.

Example embodiments being thus described, it will be obvious that the same may be varied in many ways. Such exemplary variations are not to be regarded as a departure from the spirit and scope of the present invention, and all such modifications as would be obvious to one skilled in the art are intended to be included within the scope of the following claims.

What is claimed is:

1. A packaging container for containing an object, comprising:

a substantially square-shaped first sheet member and a substantially square-shaped second sheet member overlaid on one another and forming four sides, at least one of the four sides forming an opening from which the object can be inserted into the packaging container;

a first flap connected to the first sheet member through a first fold line at the opening, the first flap includes a first cover piece configured to cover one half of the opening when folded and a first spacer connected to the first cover piece through a third fold line; and a second flap connected to the second sheet member through a second fold line at the opening, the second flap includes a second cover piece configured to cover other half of the opening when folded and a second spacer connected to the second cover piece through a fourth fold line, wherein the first flap and the second flap are provided at the opening so as not to overlap each other, and the first cover piece and the second cover piece cover substantially all the opening when folded, and wherein a direction of the first fold line intersects with a direction of the third fold line, a direction of the second fold line intersects with a fourth fold line, and the third fold line comes adjacent to the fourth fold line when folded.

2. The packaging container according to claim 1, wherein the first spacer and the second spacer maintains a space between the first sheet member and the second sheet member when inserted into the packaging container from the opening between the first sheet member and the second sheet member.

3. The packaging container according to claim 2, wherein the first spacer and the second spacer are notched with a cut, the first spacer and the second spacer engaging each other at the cut inside the packaging container when inserted into the packaging container from the opening between the first sheet member and the second sheet member.

4. The packaging container according to claim 1, wherein the first flap and the second flap further comprise a third flap and a fourth flap provided adjacent to the first cover piece and the second cover piece, respectively, and wherein the third flap is configured to extend along a rear surface of the second sheet member and contact the second sheet member when folded, and the fourth flap is configured to extend along a rear surface of the first sheet member and contact the first sheet member when folded.

5. The packaging container according to claim 2, further comprising a fold line between the first spacer and the first cover piece, and a fold line between the second spacer and the second cover piece, wherein the first spacer and the second spacer are configured to be foldable along the fold line so as to overlay the first cover piece and the second cover piece, respectively, and wherein the first spacer and the second spacer have a shape allowing the first spacer and the second spacer to be provided within a contour of the first cover piece and the second cover piece when the first spacer and the second spacer are overlaid on the first cover piece and the second cover piece, respectively.

6. The packaging container according to claim 5, further comprising a removal assisting mechanism including perforation between the first spacer and the first cover piece, and between the second spacer and the second cover piece.

7. The packaging container according to claim 3, wherein an end of the cut forms a tear prevention mechanism.

8. The packaging container according to claim 1, wherein contours of the first spacer and the second spacer are configured to be smaller than the first cover piece and the second cover piece when the first spacer and the second spacer are overlaid on the first cover piece and the second cover piece, respectively, and provide a space between the first sheet member and the second sheet member.

9. The packaging container according to claim 1, further comprising handling instructions for the packaging container provided on a surface thereof.

10. The packaging container according to claim 1, wherein the first cover piece and the second cover piece have a substantially isosceles triangular shape.

11. The packaging container according to claim 4, wherein the third flap and the fourth flap have a substantially triangular shape.

12. The packaging container according to claim 7, wherein the tear prevention mechanism is a hole.

13. The packaging container according to claim 1, wherein the first spacer and the second spacer have four sides.

14. A packaging container for containing an object, comprising:

a substantially square-shaped first sheet member and a substantially square-shaped second sheet member, the first sheet member and the second sheet member being connected to each other to form four sides, and at least one of the sides forms an opening from which the object can be inserted into the packaging container, wherein the first sheet member and the second sheet member can be overlaid one atop the other to form an envelope-like shape to accommodate a thin object or the first sheet member and the second sheet member can separated from each other to form a box-like shape to accommodate a thick object; and a flap configured to close the opening, the flap including:

a cover piece configured to cover the opening when folded; and a spacer configured to maintain a height of the opening when inserted into the packaging container from the opening between the first sheet member and the second sheet member, and configured to change a distance between the first sheet member and the second sheet member depending on whether the packaging container is formed into the envelope-like shape or the box-like shape.

15. The packaging container according to claim 14, wherein the spacer is configured to resist deformation of the packaging container.

16. A packaging container for containing an object, comprising:

a substantially square-shaped first sheet member and a substantially square-shaped second sheet member, the first sheet member and the second sheet member being connected to each other to form four sides, and at least one of the sides forms an opening from which the object can be inserted into the packaging container, wherein the first sheet member and the second sheet member can be overlaid one atop the other to form an envelope-like shape to accommodate a thin object or the first sheet member and the second sheet member can separated from each other to form a box-like shape to accommodate a thick object;

a first flap connected to the first sheet member through a first fold line at the opening, the first flap includes a first cover piece configured to cover the opening when folded and a first spacer connected to the first cover piece; and a second flap connected to the second sheet member through a second fold line at the opening, the second flap includes a second cover piece configured to cover the opening when folded and a second spacer connected to the second cover piece, wherein the first flap and the second flap are provided at the opening so as not to overlap each other, and the first cover piece and the second cover piece cover substantially all the opening when folded, wherein, in the box-like shaped packaging container, the first spacer and the second spacer are configured to maintain a height of the opening when inserted into the packaging container from the opening between the first sheet member and the second sheet member, wherein, in the envelope-like shaped packaging container, the first spacer is interposed between the first cover piece and the external surface of the second sheet member when the first flap is folded over the external surface of the second sheet member, and the second spacer is interposed between the second cover piece and the external surface of the first sheet member when the second flap is folded over the external surface of the first sheet member, and wherein a distance between the first sheet member and the second sheet member is changed depending on whether the packaging container is formed into the envelope-like shape or the box-like shape.

17. The packaging container according to claim 16, wherein the first and second spacers are configurable to be removable from the respective first and second cover pieces.

18. The packaging container according to claim 17, wherein fold lines between the first spacer and the first cover piece and between the second spacer and the second cover piece are perforated so as to easily remove the first and second spacers from the respective first and second cover pieces.

19. The packaging container according to claim 16, wherein:

the first spacer is connected to the first cover piece through a third fold line; and the second spacer is connected to the second cover piece through a fourth fold line, and when the first second spacers are inserted, a direction of the first fold line intersects with a direction of the third fold line, a direction of the second fold line intersects with the fourth fold line, and the third fold line comes adjacent to the fourth fold line when folded.

* * * * *